US010464792B2

(12) United States Patent
Quail et al.

(10) Patent No.: US 10,464,792 B2
(45) Date of Patent: Nov. 5, 2019

(54) SYSTEMS FOR CONTROLLING A VEHICLE LIFT TO PREVENT OPERATION WITHOUT PROPER STORAGE OF SUPPLEMENTAL SUPPORTS

(71) Applicant: Toyota Motor Engineering & Manufacturing North America, Inc., Erlanger, KY (US)

(72) Inventors: Adam J. Quail, Pittsfield Township, MI (US); Bradley A. Bilderback, Farmington Hills, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 396 days.

(21) Appl. No.: 15/476,072

(22) Filed: Mar. 31, 2017

(65) Prior Publication Data

US 2018/0282138 A1 Oct. 4, 2018

(51) Int. Cl.

| | |
|---|---|
| ***B66B 9/08*** | (2006.01) |
| ***B66F 7/28*** | (2006.01) |
| ***B66F 7/10*** | (2006.01) |
| ***B66F 17/00*** | (2006.01) |

(52) U.S. Cl.
CPC ..... *B66F 7/28* (2013.01); *B66F 7/10* (2013.01); *B66F 17/00* (2013.01)

(58) Field of Classification Search
CPC ..... B66B 7/28; B66B 7/10; B66B 17/00
USPC ..... 187/203, 204, 207, 209, 210, 213, 219, 187/220, 247, 277, 391–393; 254/45; 340/502, 539.23, 568.1, 572.8, 686.2, 340/12.27
See application file for complete search history.

(56) References Cited

U.S. PATENT DOCUMENTS

| | | | | |
|---|---|---|---|---|
| 5,330,315 | A * | 7/1994 | Beattie | B66F 7/04 187/219 |
| 6,817,449 | B2 | 11/2004 | Berends | |
| 6,983,196 | B2 * | 1/2006 | Green | B66F 7/04 254/45 |
| 6,991,067 | B2 | 1/2006 | Dube et al. | |
| 7,191,038 | B2 * | 3/2007 | Green | B66F 7/04 700/275 |

(Continued)

FOREIGN PATENT DOCUMENTS

| | | | |
|---|---|---|---|
| JP | 41742591 | B2 | 8/2011 |
| KR | 100858911 | B1 | 9/2008 |

*Primary Examiner* — Anthony J Salata
(74) *Attorney, Agent, or Firm* — Dinsmore & Shohl LLP

(57) ABSTRACT

A system for controlling a vehicle lift that operates to linearly displace a vehicle with respect to a floor. The system includes a supplemental support configured to be positioned between the vehicle and the floor when the vehicle is in a raised position, a support receiver configured to receive the supplemental support, a sensor configured to detect a presence or absence of the support within the support receiver, and an electronic control unit including a processor and a memory unit that is coupled to the processor. The electronic control unit configured to determine whether the supplemental support is positioned within the support receiver based on an output of the sensor, and in response to determining that the supplemental support is not positioned within the support receiver, prevent the vehicle lift from operating to linearly displace the vehicle with respect to the floor.

20 Claims, 5 Drawing Sheets

(56) References Cited

U.S. PATENT DOCUMENTS

| | | | | |
|---|---|---|---|---|
| 7,500,816 | B2 * | 3/2009 | Berends | B66F 3/46 187/210 |
| 7,712,583 | B2 * | 5/2010 | Matsumoto | B66F 7/20 187/224 |
| 8,083,034 | B2 * | 12/2011 | Bordwell | B66F 7/20 187/210 |
| 8,256,577 | B2 | 9/2012 | Kritzer | |
| 8,567,761 | B2 * | 10/2013 | De Jong | B66F 3/46 254/134 |
| 8,708,107 | B2 * | 4/2014 | Finkbeiner | B66F 7/20 187/213 |
| 9,327,953 | B2 | 5/2016 | Sayles | |
| 9,334,145 | B2 | 5/2016 | Fagan et al. | |
| 9,714,160 | B2 * | 7/2017 | Benz | B66F 7/025 |
| 10,000,367 | B2 * | 6/2018 | Finkbeiner | B66F 3/46 |
| 10,065,842 | B2 * | 9/2018 | Jaipaul | B66F 3/46 |
| 2012/0222916 | A1 | 9/2012 | Hornstein | |

* cited by examiner

SYSTEMS FOR CONTROLLING A VEHICLE LIFT TO PREVENT OPERATION WITHOUT PROPER STORAGE OF SUPPLEMENTAL SUPPORTS

TECHNICAL FIELD

The present specification generally relates to systems for controlling a vehicle lift and, more specifically, systems for controlling a vehicle lift to prevent operation without proper storage of supplemental supports.

BACKGROUND

There are currently vehicle lifts to allow for assembly, maintenance, repair, and inspection. The vehicle is positioned on the vehicle lift and a user operates the vehicle lift to raise the vehicle with respect to a floor. The user stops the operation of the vehicle lift and utilizes supplemental supports, e.g. jack stands, for additional support. The supplemental supports are positioned between the vehicle and the floor. After completion of the required task, the user removes the supplemental supports and operates the vehicle lift to lower the vehicle to the floor.

It is often the case that the supplemental supports are improperly positioned when the user operates the vehicle lift to lower the vehicle to the floor. For example, the supplemental supports often remain positioned in a support position between the vehicle and the floor when the user operates the vehicle lift to lower the vehicle to the floor. Alternatively, the supplemental supports are removed from the support position but placed on the floor such that upon operation of the vehicle lift the vehicle will be lowered onto the supplemental supports. The previously known vehicle lifts ignore the position of the supplemental supports in allowing the operation of the vehicle lift.

Accordingly, a need exists for alternative systems for controlling a vehicle lift to prevent operation of the vehicle lift when the supplemental supports are not properly stored.

SUMMARY

In one embodiment, a system for controlling a vehicle lift that operates to linearly displace a vehicle with respect to a floor includes a supplemental support, a support receiver, a sensor, and an electronic control unit. The supplemental support is configured to be positioned between the vehicle and the floor when the vehicle is in a raised position. The support receiver is configured to receive the supplemental support. The sensor is configured to detect a presence or absence of the supplemental support within the support receiver. The electronic control unit includes a processor and a memory unit that is coupled to the processor. The memory unit stores logic that, when executed by the processor, causes the electronic control unit to determine whether the supplemental support is positioned within the support receiver based on an output of the sensor. In response to determining that the supplemental support is not positioned within the support receiver, the electronic control unit prevents the vehicle lift from operating to linearly displace the vehicle with respect to the floor.

In another embodiment, a system for controlling a vehicle lift that operates to linearly displace a vehicle with respect to a floor includes a power supply, a motor, a supplemental support, a support receiver, a sensor, and a switch. The motor receives power from the power supply. The motor is configured to linearly displace the vehicle with respect to the floor. The supplemental support is configured to be positioned between the vehicle and the floor when the vehicle is in a raised position. The support receiver is configured to receive the supplemental support. The sensor is configured to detect a presence or absence of the supplemental support within the support receiver. The switch is positioned between the power supply and the motor. The switch is moveable between an open position in which the power supply is disconnected from the motor and a closed position in which the power supply is connected to the motor. The switch is in the open position when the sensor detects the absence of the supplemental support within the support receiver and the switch is in the closed position when the sensor detects the presence of the supplemental support within the support receiver.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
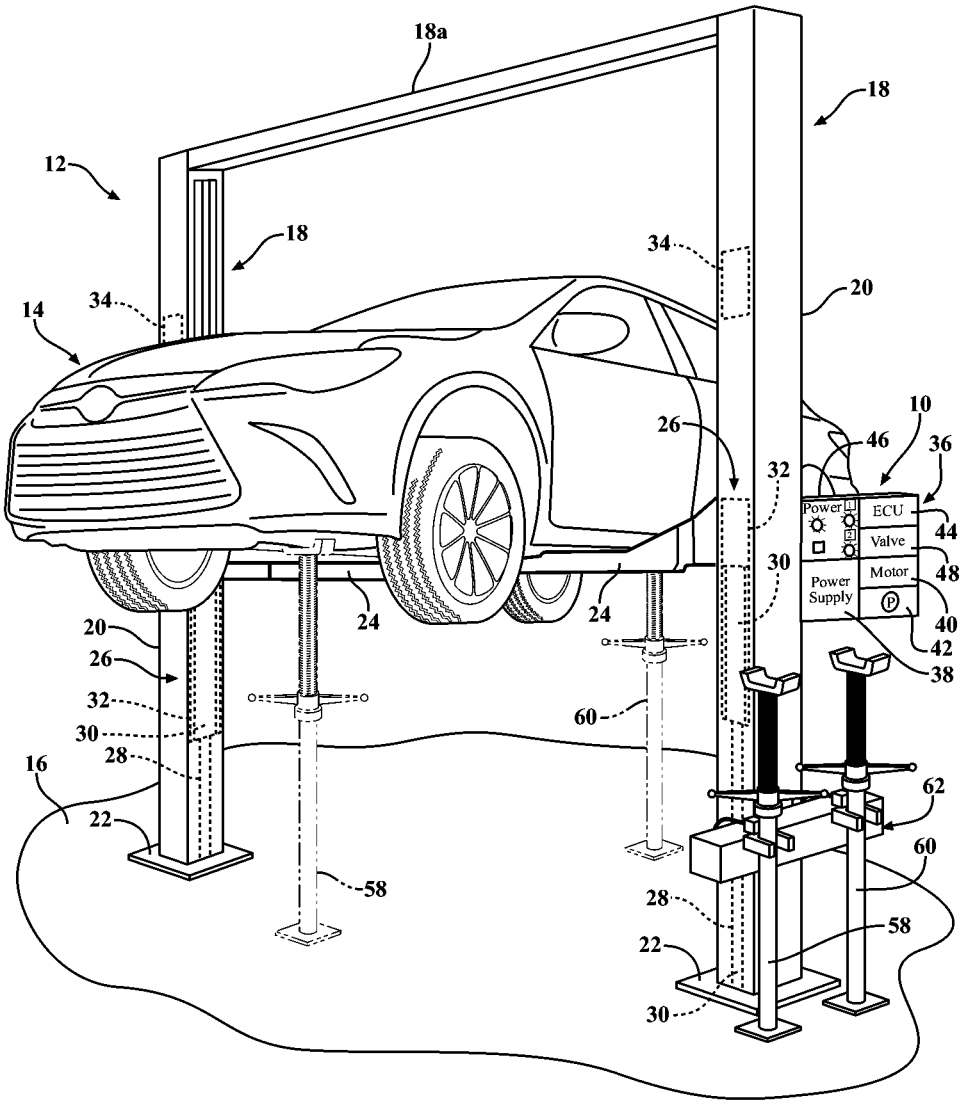
FIG. 1 schematically depicts an environment for a system for controlling a vehicle lift that operates to linearly displace a vehicle, according to one or more embodiments shown and described herein.

FIG. 1 generally depicts an embodiment of a system for controlling a vehicle lift that operates to linearly displace a vehicle with respect to a floor. The system for controlling the vehicle lift generally comprises a supplemental support, a support receiver configured to receive the supplemental support, a sensor, and a display device. Various embodiments of the systems and the operation of system for controlling a vehicle lift are described in more detail herein.

Embodiments disclosed herein include systems for controlling a vehicle lift to prevent operation of the vehicle lift without proper storage of the supplemental support. Some embodiments include hardware and/or software for determining whether the supplemental support is positioned within the support receiver or where the supplemental support is in an out-of-stowed condition. Specifically, the embodiments disclosed herein may be configured to prevent the vehicle lift from operating to linearly displace the vehicle when the supplemental support is in an out-of-stowed condition (i.e., is not positioned within the support receiver or positioned in the support receiver incorrectly). Preventing the vehicle lift from operating to linearly displace the vehicle when the supplemental support is not positioned within the support receiver, prevents the supplemental supports from interfering with the linear displacement of the vehicle by the vehicle lift.

In some embodiments, the systems detect the presence or absence of the supplemental support within the support receiver. Specifically, the systems include a sensor that detects the presence or absence of the supplemental support within the support receiver and provides an indication of an out-of-stowed condition. As such, the systems can determine whether the supplemental support is positioned within the support receiver based on an output of the sensor. When it is determined that the supplemental support is not positioned within the support receiver, the systems and methods prevent the vehicle lift from operating to linearly displace the vehicle with respect to the floor.

In some embodiments, the systems includes a power supply, a motor, a supplemental support, a support receiver, and a switch. The switch is positioned between the power supply and the motor. The switch is moveable between an open position and a closed position based on an output of the sensor. In the open position, the power supply is disconnected from the motor. In the closed position, the power supply is connected to the motor. The switch is in the open position when the sensor detects the absence of the supplemental support within the support receiver or the out-of-stowed condition and the switch is in the closed position when the sensor detects the presence of the supplemental support within the support receiver.

Referring now to the drawings, FIG. 1 schematically depicts an environment of a system 10 for controlling a vehicle lift 12. As illustrated, the system 10 is provided for a vehicle lift 12 that operates to linearly displace a vehicle 14 vertically with respect to a floor 16. The vehicle lift 12 is a two post lift having a pair of spaced apart columns 18. Each of the pair of columns 18 includes a post 20 extending upwardly from a column base 22, and a lift carriage 24 moveably attached to the post 20. An overhead beam 18*a* is provided to connect the pair of columns 18 together at an upper end thereof. The overhead beam 18*a* allows for various conduits and cables to be routed between the pair of columns 18.

The lift carriage 24 extends outwardly from of each of the pair of columns 18. The lift carriage 24 includes armatures that engage with an undercarriage of the vehicle 14. Each of the column bases 22 are secured to the floor 16 either fixedly or releasably. Each of the pair of columns 18 includes a respective actuator 26 that operates to linearly displace the lift carriage 24 along the respective post 20.

In some embodiments, the respective actuators 26 are hydraulic actuators having a rod 28 connected to a piston 30 that is slidably received within a cylinder 32. A distal end of the rod 28 is connected to the column base 22 inside the post 20. The cylinder 32 is partially received within and connected to a portion of the lift carriage 24 positioned within the post 20. As will be discussed in greater detail below, hydraulic fluid is pumped into the cylinder 32 of each of the actuators 26 to raise the vehicle 14 on the vehicle lift 12. Similarly, hydraulic fluid is released from the cylinder 32 of each of the actuators 26 to lower the vehicle 14 on the vehicle lift 12.

In some embodiments, the vehicle lift 12 is provided with a mechanical safeguard 34 to prevent unintended lowering of the vehicle 14. The mechanical safeguard 34 is provided in one or both of the pair of columns 18. The mechanical safeguard 34 prevents the lift carriage 24 from being lowered from a raised position inadvertently. Specifically, the mechanical safeguard 34 requires that the lift carriage 24 be first linearly displaced upwards to disengage the mechanical safeguard 34 prior to the lift carriage 24 from being lowered from the raised position.

Figure 2:
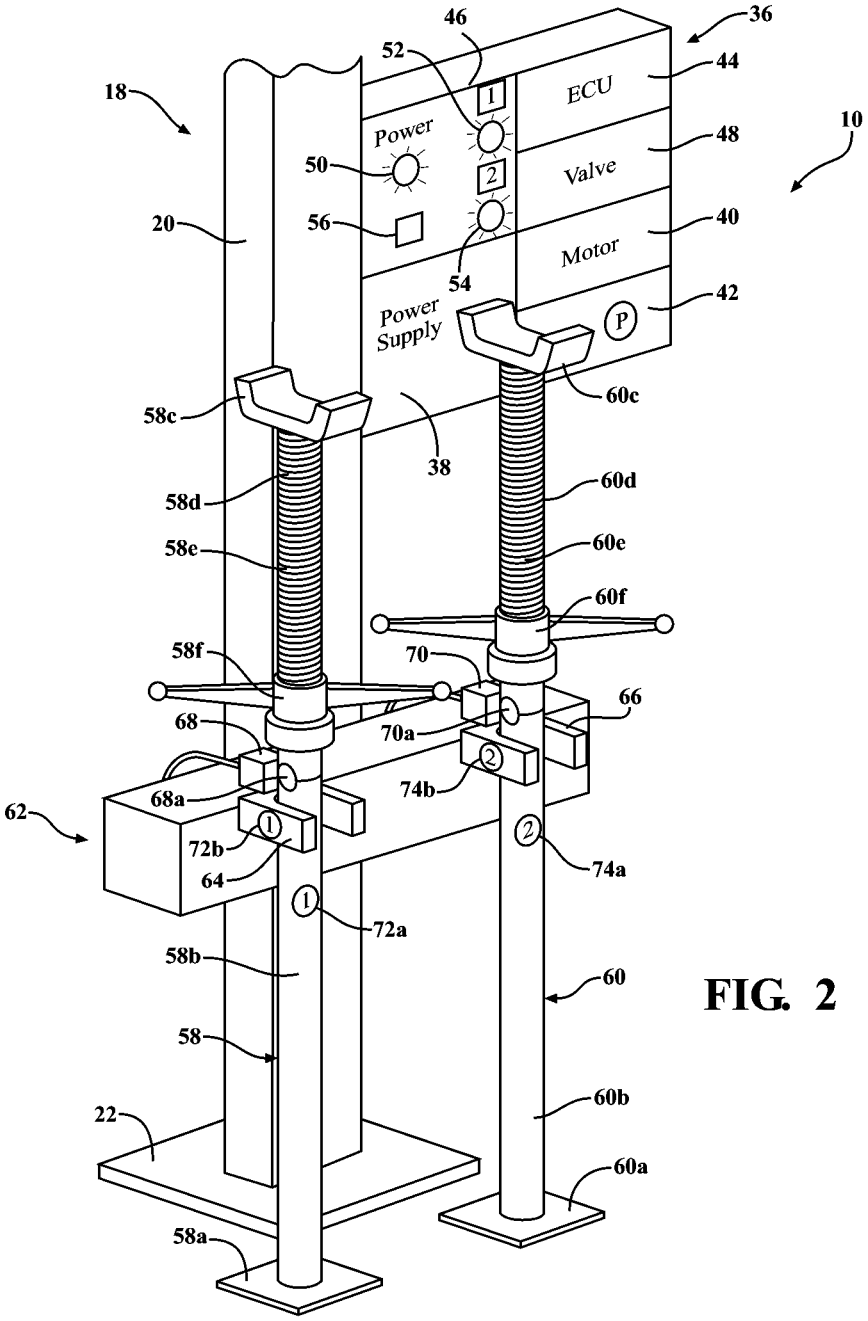
FIG. 2 schematically depicts a support station and a display device, according to one or more embodiments shown and described herein.

Referring now to FIGS. 1 and 2, the linear displacement of the vehicle 14 by the vehicle lift 12 is controlled by a control unit 36, which will be described in greater detail below. The control unit 36 includes a power supply 38, a motor 40, a hydraulic pump 42, an electronic control unit 44, a display device 46, and a hydraulic release valve 48.

The motor 40, such as an AC electric motor, is connected to the power supply 38 to supply power to allow the motor 40 to drive the hydraulic pump 42. The hydraulic pump 42 circulates hydraulic fluid from the reservoir (not shown) to the cylinder 32 of each of the actuators 26 to move the lift carriages 24 along the posts 20 to linearly displace the vehicle 14 with respect to the floor 16.

The electronic control unit 44 is operatively connected to the power supply 38, the motor 40, the hydraulic pump 42, the display device 46 and the hydraulic release valve 48. The electronic control unit 44 will be discussed in greater detail below.

The display device 46 is provided to display information to the user. As discussed in greater detail below, the display device 46 includes an operation indicator 50, a first support indicator 52, a second support indicator 54, and an input 56 (FIG. 2). The input 56 is operable by a user to control the vehicle lift 12 to linearly displace the vehicle 14 with respect to the floor 16. Specifically, the user operates the input 56 to either raise or lower the vehicle 14.

The operation indicator 50 and the first support indicator 52 and the second support indicator 54 are lights which when illuminated indicate the status of aspects of the system 10. Specifically, the operation indicator 50 is illuminated to indicate to the user that the vehicle lift 12 is operational to linearly displace the vehicle 14 upon actuation of the input 56. As will be discussed in greater detail below, the first support indicator 52 and the second support indicator 54 are illuminated to indicate a that a first supplemental support 58 and a second supplemental support 60 are properly stored within the first support receiver 64 and the second support receiver 66.

The hydraulic release valve 48 is a valve that is opened to allow for the hydraulic fluid in the cylinders 32 of each of the actuators 26 to return to the reservoir (not shown), thereby lowering the vehicle 14 on the vehicle lift 12. The control unit 36 optionally includes a single hydraulic release valve 48 for both actuators 26 or a hydraulic release valve 48 for each of the actuators 26. The hydraulic release valve 48 is either directly operated, i.e. manually opened, or indirectly operated, i.e. using electronically operated using the power supply 38. In some embodiments, the hydraulic release valve 48 is indirectly operated by the user via the input 56.

The system 10 also includes a support station 62 that includes the first support receiver 64 and the second support receiver 66. The first support receiver 64 is configured to store one of the first supplemental support 58 and the second supplemental support 60. The second support receiver 66 is configured to store the other of the first supplemental support 58 and the second supplemental support 60. Each of the first support receiver 64 and the second support receiver 66 are formed having a generally U-shape with which one of the first supplemental support 58 or the second supports is positioned therein. The first supplemental support 58 and the second supplemental support 60 are properly stored when positioned within the first support receiver 64 and the second support receiver 66.

The first supplemental support 58 and the second supplemental support 60 are jack stands that are positioned between the floor 16 and the vehicle 14 when the vehicle 14 is in a raised position, as shown in FIG. 1. Referring now to FIG. 2, the first supplemental support 58 and the second supplemental support 60 include a support base 58*a*, 60*a* attached to lower sections 58*b*, 60*b*, and a vehicle engagement portion 58*c*, 60*c* attached to an upper section 58*d*, 60*d*. One of the lower sections 58*b*, 60*b* or the upper sections 58*d*, 60*d* are provided with external threads 58*e*, 60*e*, and the other of the lower sections 58*b*, 60*b* or the upper sections 58*d*, 60*d* are provided with internal threads (not shown). A collar 58*f*, 60*f* is used to adjust the height of the first supplemental support 58 and the second supplemental support 60 due to the engagement of the internal threads and the external threads 58*e*, 60*e*.

The support station 62 also includes a first sensor 68 and a second sensor 70 positioned adjacent to the first support receiver 64 and the second support receiver 66, respectively. The first sensor 68 and the second sensor 70 are connected to the electronic control unit 44. The first sensor 68 and the second sensor 70 are configured to detect the presence or absence of the first supplemental support 58 and the second supplemental support 60 therein. Specifically, the first sensor 68 and the second sensor 70 output a signal that is used to determine whether one of the first supplemental support 58 or the second supplemental support 60 is positioned within one of the first support receiver 64 or the second support receiver 66 or whether an out-of-stowed condition is present.

In some embodiments, the first sensor 68 is configured to detect the presence or absence of either one of the first supplemental support 58 or the second supplemental support 60 within the first support receiver 64. Similarly, the second sensor 70 is configured to detect the presence or absence of either one of the first supplemental support 58 or the second supplemental support 60 within the second support receiver 66.

In some other embodiments, the first sensor 68 is configured to detect the presence or absence of only the first supplemental support 58 within the first support receiver 64, and the second sensor 70 is configured to detect the presence or absence of only the second supplemental support 60 within the second support receiver 66.

In some embodiments, the first sensor 68 and the second sensor 70 are RFID (Radio-Frequency Identification) readers and the first supplemental support 58 includes a first RFID tag 68*a* provided thereon and the second supplemental support 60 includes a second RFID tag 70*a* provided thereon. In some embodiments, the first sensor 68 is configured to detect the presence or absence of either one of the first RFID tag 68*a* or the second RFID tag 70*a*. Similarly, the second sensor 70 is configured to detect the presence or absence of either one of the first RFID tag 68*a* or the second RFID tag 70*a*. In some other embodiments, the first sensor 68 is keyed to only detect the presence or absence of the first RFID tag 68*a* provided on the first supplemental support 58, and the second sensor 70 is keyed to only detect the presence or absence of the second RFID tag 70*a* provided on the second supplemental support 60.

The first supplemental support 58 and the second supplemental support 60 are provided with indicia 72*a* and 74*a* that correspond to indicia 72*b* and 74*b* provided on the first support receiver 64 and the second support receiver 66, respectively. Specifically, the indicia 72*a* corresponds to the indicia 72*b* to allow a user to correctly identify that the first supplemental support 58 is to be received within the first support receiver 64. Similarly, the indicia 74*a* corresponds to the indicia 74*b* to allow a user to correctly identify that the second supplemental support 60 is to be received within the second support receiver 66.

Figure 3:
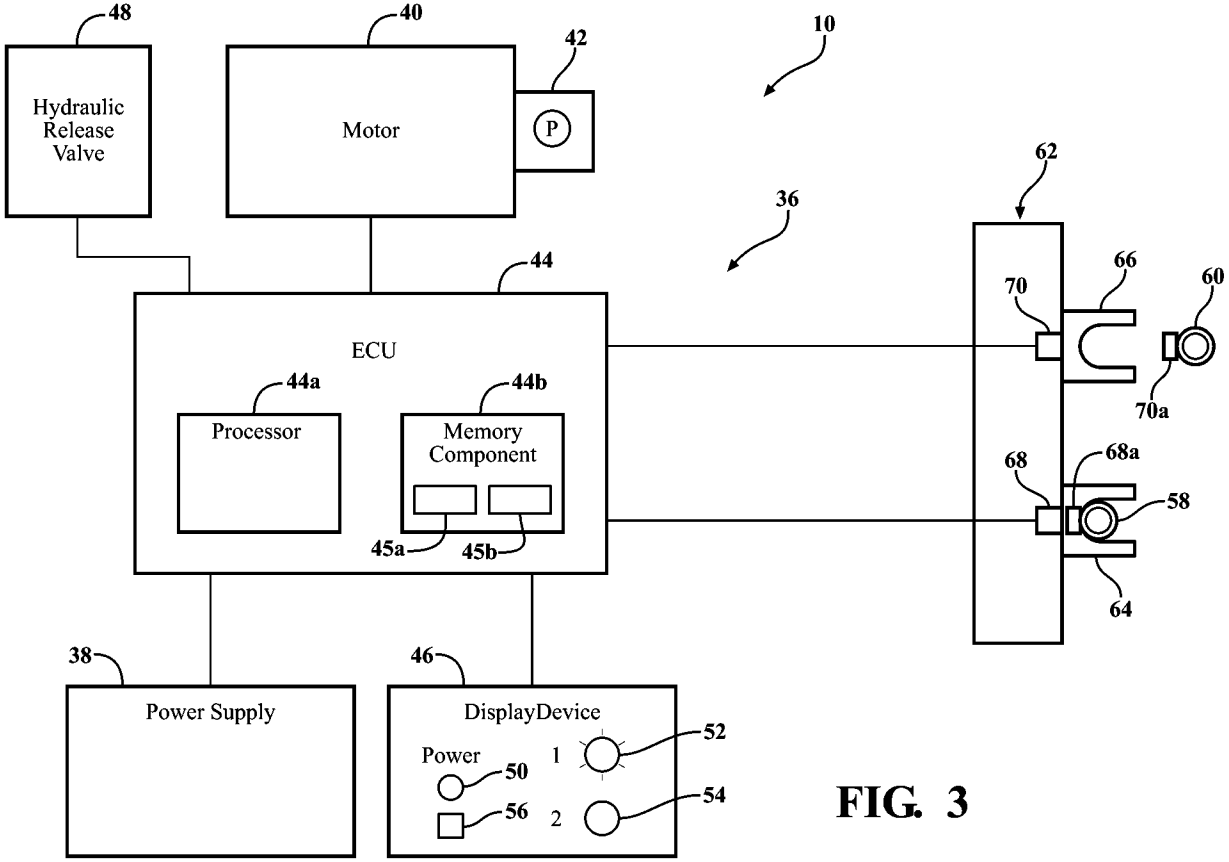
FIG. 3 schematically depicts a system for controlling a vehicle lift that operates to linearly displace a vehicle, according to one or more embodiments shown and described herein.

With reference to FIG. 3, the electronic control unit 44 of the control unit 36 is discussed in greater detail. The electronic control unit 44 includes a processor 44*a* and a memory component 44*b* coupled to the processor 44*a*. The processor 44*a* includes processing components operable to receive and execute instructions from the memory component 44*b*.

The memory component 44*b* stores detection logic 45*a* and control logic 45*b*. The detection logic 45*a* and the control logic 45*b* may each include a plurality of different pieces of logic, each of which may be embodied as a computer program, firmware, and/or software/hardware.

In some embodiments, the memory component 44*b* is configured as volatile and/or nonvolatile memory and as such may include random access memory (SRAM, DRAM, and/or other types of RAM), flash memory, secure digital (SD) memory, registers, compact discs, digital versatile discs (DVD), and/or other types of nontransitory computer readable mediums. Depending on the particular embodiments, these nontransitory computer readable mediums may reside within the electronic control unit 44 and/or external to the electronic control unit 44 and the control unit 36.

The detection logic 45*a* is executable by the processor 44*a* to detect one or more signals output from the first sensor 68 and the second sensor 70. For example, the detection logic 45*a* is configured to cause the processor 44*a* to determine the presence or absence of the first supplemental support 58 and the second supplemental support 60 within the first support receiver 64 and/or the second support receiver 66 based on the signal output from the first sensor 68 and the second sensor 70. Specifically, processor 44*a* determines the presence or absence of the first supplemental support 58 and the second supplemental support 60 based on output signals from the first sensor 68 and the second sensor 70.

The control logic 45*b* controls operation of the vehicle lift 12 to prevent or allow the vehicle lift 12 from operating to linearly displacing the vehicle 14 with respect to the floor 16 when an out-of-stowed condition is present. The control logic 45*b* allows the vehicle lift 12 to operate to linearly displace the vehicle 14 with respect to the floor 16, when it is determined by the processor 44*a* that the first supplemental support 58 and the second supplemental support 60 are received within the first support receiver 64 and the second support receiver 66. The control logic 45*b* only allows for the vehicle lift 12 to operate when both the first supplemental support 58 and the second supplemental support 60 are properly stored within the first support receiver 64 and the second support receiver 66 (i.e. positioned within the first support receiver 64 and the second support receiver 66). In some embodiments, the control logic 45*b* only allows for the vehicle lift 12 to operate when the first supplemental support 58 is properly positioned within the first support receiver 64 and the second supplemental support 60 is properly positioned within the second support receiver 66.

The control logic 45*b* prevents the vehicle lift 12 from operating to linearly displace the vehicle 14 with respect to the floor 16 in response to the determination by the processor 44*a* that the first supplemental support 58 and the second supplemental support 60 are not positioned within the first support receiver 64 and the second support receiver 66. Specifically, when it is determined by the processor 44*a* that one of the first supplemental support 58 and the second supplemental support 60 is not positioned within one of the first support receiver 64 and the second support receiver 66 (an out-of-stowed condition is present), the control logic 45*b* prevents the vehicle lift 12 from operating to linearly displacing the vehicle 14 with respect to the floor 16.

In some embodiments, the control logic 45*b* prevents the vehicle lift 12 from operating to linearly displacing the vehicle 14 with respect to the floor 16, when it is determined that the first supplemental support 58 is not positioned within the first support receiver 64 or when it is determined that the second supplemental support 60 is not positioned within the second support receiver 66.

Similarly, the control logic 45*b* allows the vehicle lift 12 to operate to linearly displacing the vehicle 14 with respect to the floor 16 in response to the determination by the processor 44*a* that the first supplemental support 58 and the second supplemental support 60 are positioned within the first support receiver 64 and the second support receiver 66.

The control logic 45*b* controls the linear displacement of the vehicle 14 by the vehicle lift 12 by controlling operation of the actuators 26. The control logic 45*b* controls operation of the actuators 26 by controlling the operation of the motor 40, the hydraulic pump 42, the hydraulic release valve 48, and the input 56. Specifically, the control logic 45*b* prevents operation of the motor 40, the hydraulic pump 42, the hydraulic release valve 48 in response to an operation command from the input 56 to raise or lower the vehicle 14 on the vehicle lift 12.

By preventing operation of the motor 40, the hydraulic pump 42 is prevented from operating to raise the vehicle 14 on the vehicle lift 12. Further, as the mechanical safeguard 34 requires that the vehicle 14 be raised to disengage the mechanical safeguard 34 prior to lowering the vehicle 14, operation of the vehicle lift 12 to lower the vehicle 14 is also prevented. Therefore, the control logic 45*b* prevents the vehicle lift 12 from operating to linearly displace (raise or lower) the vehicle with respect to the floor 16.

In some embodiments, the hydraulic release valve 48 is electronically controlled by an operation command from the input 56. As the control logic 45*b* controls the operation of the hydraulic release valve 48 and the input 56, operation of the vehicle lift 12 to lower the vehicle 14 by opening the hydraulic release valve 48 in response to an operation command from the input 56 is prevented. Therefore, the control logic 45*b* prevents the vehicle lift 12 from operating to linearly displace (lower) the vehicle with respect to the floor 16.

In some embodiments, the control logic 45*b* controls the input 56. Specifically, the control logic 45*b* prevents an operation command from the input 56 to raise (i.e. operate the motor 40 and the hydraulic pump 42) or lower (i.e. operate the motor 40 and the hydraulic pump 42 to disengage the mechanical safeguard 34 or operate the hydraulic release valve 48) from being executed. Therefore, the control logic 45*b* prevents the vehicle lift 12 from operating to linearly displace (raise or lower) the vehicle with respect to the floor 16.

Still referring to FIG. 3, the control logic 45*b* further controls the operation indicator 50, the first support indicator 52, and the second support indicator 54. Specifically, the control logic 45*b* controls the first support indicator 52 to indicate whether or not one of the first supplemental support 58 and the second supplemental support 60 is positioned within the first support receiver 64. The control logic 45*b* controls the second support indicator 54 to indicate whether or not one of the first supplemental support 58 and the second supplemental support 60 is positioned within the second support receiver 66. The control logic 45*b* also controls the operation indicator 50 to indicate whether or not the vehicle lift 12 is operable to linearly displace the vehicle 14 with respect to the floor 16, when both the first supplemental support 58 and the second supplemental support 60 are positioned within the first support receiver 64 and the second support receiver 66.

In some embodiment's, the control logic 45*b* controls the first support indicator 52 to indicate whether or not the first supplemental support 58 is positioned within the first support receiver 64. The control logic 45*b* controls the second support indicator 54 to indicate whether or not the second supplemental support 60 is positioned within the second support receiver 66. The control logic 45*b* also controls the operation indicator 50 to indicate that the vehicle lift 12 is operable to linearly displace the vehicle 14 with respect to the floor 16, only when the first supplemental support 58 is positioned within the first support receiver 64 and the second supplemental support 60 is positioned within the second support receiver 66.

Still referring to FIG. 3, as the first supplemental support 58 is stored (i.e. positioned) within the first support receiver 64, the control logic 45*b* controls the first support indicator 52 to illuminate so as to indicate that a support is positioned within the first support receiver 64. As the second supplemental support 60 is not stored (i.e. not positioned or positioned incorrectly) within the second support receiver 66, the control logic 45*b* controls the second support indicator 54 not to illuminate so as to indicate that a support is not positioned within the second support receiver 66. As both the first supplemental support 58 and the second supplemental support 60 are not properly positioned within the first support receiver 64 and the second support receiver 66, the control logic 45*b* controls the operation indicator 50 not to illuminate so as to indicate that the vehicle lift 12 is prevented from operating to linearly displace the vehicle 14 with respect to the floor 16.

Figure 4:
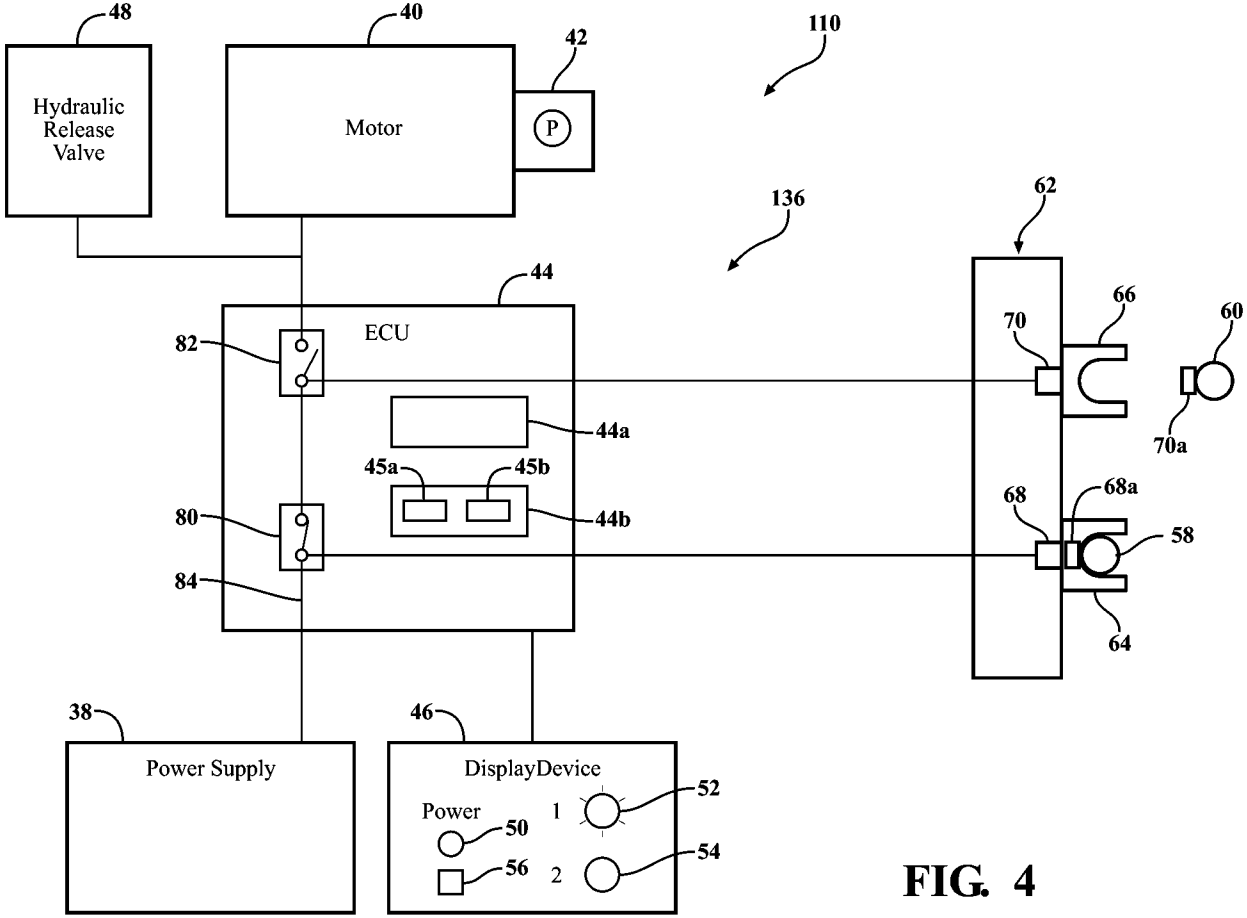
FIG. 4 schematically depicts a system for controlling a vehicle lift that operates to linearly displace a vehicle, according to one or more embodiments shown and described herein.

Referring to FIG. 4, a system for controlling a vehicle lift is generally illustrated at 110. The system 110 is similar to the system 10, except that the system 110 includes a first switch 80 and a second switch 82 provided on a power supply line 84 that connects the power supply 38 to the motor 40, the hydraulic pump 42, and the hydraulic release valve 48. The first switch 80 and the second switch 82 are moveable between an open position and a closed position.

In the open position, the power supply 38 is disconnected from the motor 40, the hydraulic pump 42, and the hydraulic release valve 48. When the power supply 38 is disconnected from the motor 40, the hydraulic pump 42, and the hydraulic release valve 48, the vehicle lift 12 is prevented from operating to linearly displace the vehicle 14 with respect to the floor 16. Specifically, as the motor 40, the hydraulic pump 42, and the hydraulic release valve 48 are disconnected from the power supply 38 no power is being supplied and the motor 40, the hydraulic pump 42, and the hydraulic release valve 48 are unable to be operated in response to an operation command from the input 56.

In the closed position, the power supply 38 is connected to the motor 40, the hydraulic pump 42, and the hydraulic release valve 48. When the power supply 38 is connected to the motor 40, the hydraulic pump 42, and the hydraulic release valve 48, the vehicle lift 12 is allowed to operate to linearly displace the vehicle 14 with respect to the floor 16. Specifically, as the motor 40, the hydraulic pump 42, and the hydraulic release valve 48 are connected to the power supply 38 power is being supplied and the motor 40, the hydraulic pump 42, and the hydraulic release valve 48 are able to be operated in response to an operation command from the input 56.

In some embodiments, both the first switch 80 and the second switch 82 are required to be in the closed position to connect the motor 40, the hydraulic pump 42, and the hydraulic release valve 48. As such, in the event that one of the first switch 80 and the second switch 82 is in the open position while the other of the first switch 80 and the second switch 82 is in the closed position, the motor 40, the hydraulic pump 42, and the hydraulic release valve 48 will be disconnected from the power supply 38.

The first switch 80 is moveable from the open position to the closed position when the first sensor 68 detects that one of the first supplemental support 58 and the second supplemental support 60 is positioned within the first support receiver 64. The first switch 80 is moveable from the closed position to the open position when the first sensor 68 detects that one of the first supplemental support 58 and the second supplemental support 60 is not positioned within the first support receiver 64

The second switch 82 is moveable from the open position to the closed position when the second sensor 70 detects that one of the first supplemental support 58 and the second supplemental support 60 is positioned within the second support receiver 66. The second switch 82 is moveable from the closed position to the open position when the second sensor 70 detects that one of the first supplemental support 58 and the second supplemental support 60 is not positioned within the second support receiver 66.

In some embodiments, the first switch 80 is only in the closed position when the first sensor 68 detects that the first supplemental support 58 is positioned within the first support receiver 64. Similarly, the second switch 82 is only in the closed position when the second sensor 70 detects that the second supplemental support 60 is positioned within the second support receiver 66.

In some embodiments, the first switch 80 and the second switch 82 are controlled to move between the open position and the closed position by the control logic 45*b* based on an output of the first sensor 68 and the second sensor 70. In some embodiments, the first switch 80 and the second switch 82 are controlled to move between the open position and the closed position directly based on an output of the first sensor 68 and the second sensor 70.

Still referring to FIG. 4, as the first supplemental support 58 is stored (i.e. positioned) within the first support receiver 64, the control logic 45*b* controls the first support indicator 52 to illuminate so as to indicate that a support is positioned within the first support receiver 64. As the second supplemental support 60 is not stored (i.e. not positioned) within the second support receiver 66, the control logic 45*b* controls the second support indicator 54 not to illuminate so as to indicate that a support is not positioned within the second support receiver 66. As both the first supplemental support 58 and the second supplemental support 60 are not properly positioned within the first support receiver 64 and the second support receiver 66, the control logic 45*b* controls the operation indicator 50 not to illuminate so as to indicate that the vehicle lift 12 is prevented from operating to linearly displace the vehicle 14 with respect to the floor 16.

Figure 5:
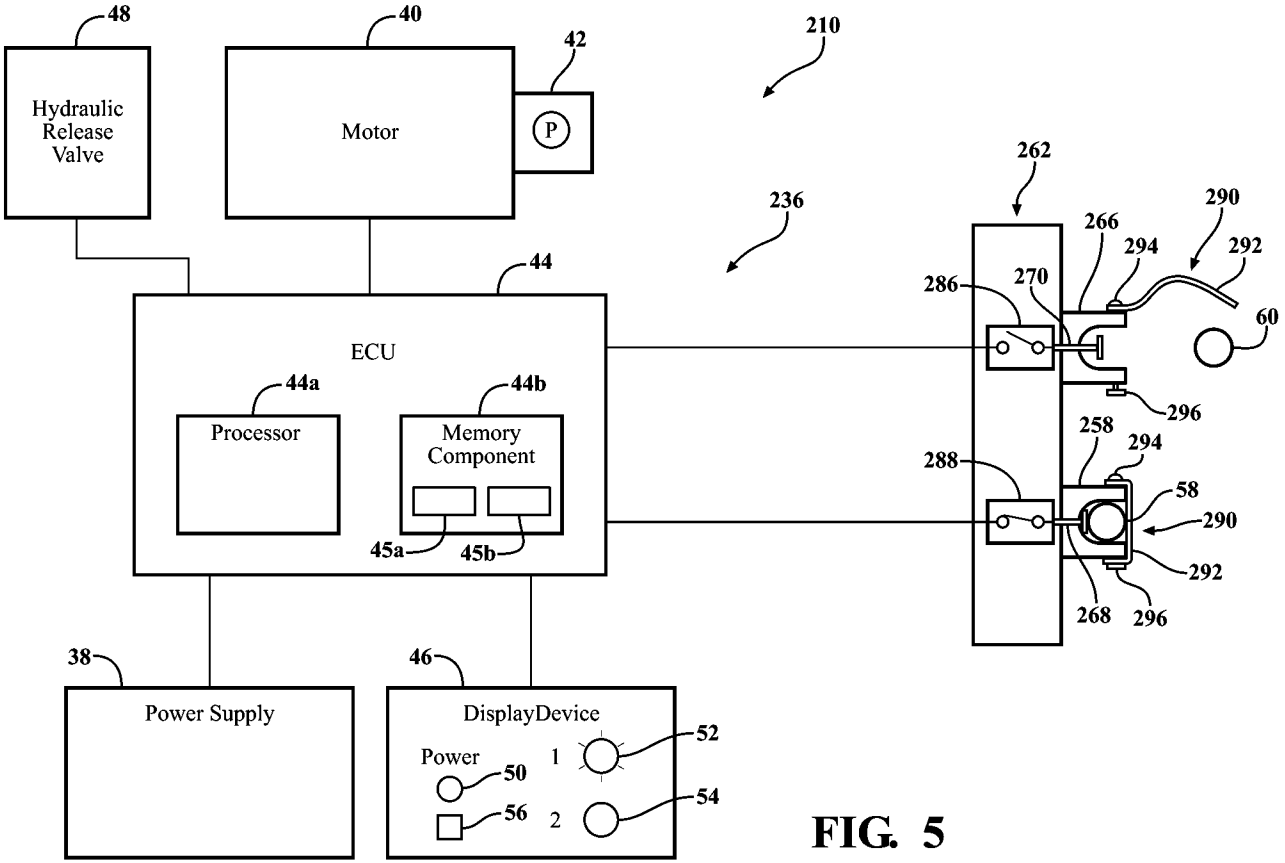
FIG. 5 schematically depicts a system for controlling a vehicle lift that operates to linearly displace a vehicle, according to one or more embodiments shown and described herein.

Referring to FIG. 5, a system for controlling a vehicle lift is generally illustrated at 210. The system 210 is similar to the system 10, except that the system 210 includes a first support receiver 264 having a first switch 286 connected to a first sensor 268 and a second support receiver 266 having a second switch 288 connected to a second sensor 270. The first sensor 268 and the second sensor 270 are spring plunger sensors moveable between an extended position and a depressed position. The first sensor 268 and the second sensor 270 are positioned on the support station 62 so as to partially extend into the first support receiver 264 and the second support receiver 266 when in the extend position.

The first sensor 268 and the second sensor 270 are biased towards the extended position. The first sensor 268 and the second sensor 270 are moveable from the extended position to the depressed position when one of the first supplemental support 58 or the second supplemental support 60 are stored within the first support receiver 264 and the second support receiver 266, respectively.

In the extended position, the first sensor 268 and the second sensor 270 detect the absence of the first supplemental support 58 and the second supplemental support 60 within the first support receiver 64 and the second support receiver 66. In the extended position, the first sensor 268 and the second sensor 270 detect the presence of the first supplemental support 58 and the second supplemental support 60 within the first support receiver 64 and the second support receiver 66.

Each of the first support receiver 264 and the second support receiver 266 includes a locking mechanism 290 such as a latch or hasp. Each of the locking mechanisms 290 includes a lid member 292 pivotally coupled to respective first support receiver 264 and the second support receiver 266 by a hinge 294. An engagement member 296 is provided on an opposite side of the first support receiver 264 and the second support receiver 266 from the hinge 294.

The engagement member 296 engages with the lid member 292 to retain the locking mechanism 290 in a closed position, as shown in the first support receiver 264 of FIG. 5. In the closed position, the locking mechanism 290 retains the first supplemental support 58 and the second supplemental support 60 within the first support receiver 264 and the second support receiver 266. Specifically, in the closed position the locking mechanism 290 prevents the first supplemental support 58 or the second supplemental support 60 from moving out of the first support receiver 264 or the second support receiver 266 which would move the first sensor 268 or the second sensor 270 from the depressed position to the extend position. In an open position, the locking mechanism 290 allows the inserting and removal of the first supplemental support 58 or the second supplemental support 60 with respect to the first support receiver 264 or the second support receiver 266.

In the system 210, the operation of the vehicle lift 12 is allowed when both the first supplemental support 58 and the second supplemental support 60 are properly positioned within the first support receiver 64 and the second support receiver 66. Similarly, the operation of the vehicle lift 12 is prevented when at least one of the first supplemental support 58 and the second supplemental support 60 is not properly positioned within the first support receiver 64 or the second support receiver 66.

In some embodiments, the system 210 prevents the operation of the vehicle 14 by controlling operation of the actuators 26 using the control logic 45*b*. Specifically, the control logic 45*b* controls operation of the actuators 26 by controlling the operation of the motor 40, the hydraulic pump 42, the hydraulic release valve 48, and the input 56. Specifically, the control logic 45*b* prevents operation of the motor 40, the hydraulic pump 42, the hydraulic release valve 48 in response to an operation command from the input 56.

In some other embodiments, the first switch 286 and the second switch 288 are mechanically coupled to the first sensor 268 and the second sensor 270, respectively. The system 210 prevents the operation of the vehicle 14 by disconnecting the power supply 38 from the motor 40, the hydraulic pump 42, the hydraulic release valve 48. Specifically, the first switch 286 and the second switch 288 are provided on the power supply line 84, and when either one of the first switch 286 or the second switch 288 is in the open position, the motor 40, the hydraulic pump 42, the hydraulic release valve 48 are disconnected from the power supply 38.

Still referring to FIG. 5, as the first supplemental support 58 is stored (i.e. positioned) within the first support receiver 264, the control logic 45*b* controls the first support indicator 52 to illuminate so as to indicate that a support is positioned within the first support receiver 264. As the second supplemental support 60 is not stored (i.e. not positioned) within the second support receiver 266, the control logic 45*b* controls the second support indicator 54 not to illuminate so as to indicate that a support is not positioned within the second support receiver 66. As both the first supplemental support 58 and the second supplemental support 60 are not properly positioned within the first support receiver 264 and the second support receiver 266, the control logic 45*b* controls the operation indicator 50 not to illuminate so as to indicate that the vehicle lift 12 is prevented from operating to linearly displace the vehicle 14 with respect to the floor 16.

It should now be understood that the system for controlling a vehicle lift that operates to linearly displace a vehicle with respect to a floor, includes a support configured to be positioned between the vehicle and the floor when the vehicle is in a raised position, a support receiver configured to receive the support, a sensor configured to detect a presence or absence of the support within the support receiver, and an electronic control unit including a processor and a memory unit that is coupled to the processor, the memory unit stores logic that, when executed by the processor, causes the electronic control unit to: determine whether the support is positioned within the support receiver based on an output of the sensor, and in response to determining that the support is not positioned within the support receiver, prevent the vehicle lift from operating to linearly displace the vehicle with respect to the floor.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A system for controlling a vehicle lift that operates to linearly displace a vehicle with respect to a floor, the system comprising:

a supplemental support configured to be positioned between the vehicle and the floor when the vehicle is in a raised position;

a support receiver configured to receive the support;

a sensor configured to detect a presence or absence of the support within the support receiver; and an electronic control unit including a processor and a memory unit that is coupled to the processor, the memory unit stores logic that, when executed by the processor, causes the electronic control unit to:

determine whether the support is positioned within the support receiver based on an output of the sensor; and in response to determining that the support is not positioned within the support receiver, prevent the vehicle lift from operating to linearly displace the vehicle with respect to the floor.

2. The system of claim 1, wherein the electronic control unit is configured to allow the vehicle lift to operate to linearly displace the vehicle with respect to the floor, in response to determining that the support is positioned within the support receiver.

3. The system of claim 1 further comprising:

a power supply;

a motor that receives power from the power supply, the motor configured to linearly displace the vehicle with respect to the floor; and a power supply configured to supply power to the motor;

wherein the electronic control unit is configured to prevent the power supply from supplying power to the motor to prevent the vehicle lift from operating to linearly displace the vehicle with respect to the floor, in response to determining that the support is not positioned within the support receiver.

4. The system of claim 1 further comprising a display device having a support indicator and an operation indicator, wherein in response to determining that the support is positioned within the support receiver, the electronic control unit is configured to control the support indicator to indicate that the support is positioned within the support receiver and control the operation indicator to indicate vehicle lift is configured to allow the vehicle lift to operate to linearly displace the vehicle with respect to the floor.

5. The system of claim 1, wherein the support includes a RFID tag and the sensor is a RFID reader that detects the presence or absence of the RFID tag on the support.

6. The system of claim 1, wherein the support is a pair of supplemental supports, the support receiver is a pair of support receivers, and the sensor is a pair of sensors, wherein the pair of sensors are configured to detect the presence or absence of the pair of supports within the pair of support receivers, and wherein the electronic control unit is configured to determine whether each of the pair of supports are positioned within the pair of support receivers based on an output of the pair of sensors, and in response to determining that the both of the pair of supports are not positioned within the pair of support receivers, prevent the vehicle lift from operating to linearly displace the vehicle with respect to the floor.

7. The system of claim 6, wherein one of the pair of sensors is provided on each of the pair of support receivers.

8. The system of claim 1, wherein the support is a first supplemental support and a second supplemental support, the support receiver is a first support receiver and a second support receiver, and the sensor is a first sensor and a second sensor, wherein the first sensor is configured to detect the presence or absence of the first support within the first support receiver and the second sensor is configured to detect the presence or absence of the second support within the second support receiver, and wherein the electronic control unit is configured to:

determine whether the first support is positioned within the first support receiver and determine whether the second support is positioned within the second support receiver, and in response to determining that the first support receiver is not positioned within the first support receiver based on an output of the first sensor and that the second support is not positioned within the second support receiver based on an output of the second sensor, prevent the vehicle lift from operating to linearly displace the vehicle with respect to the floor.

9. The system of claim 8, wherein the first support includes a first RFID tag and the second support includes a second RFID tag, and the first sensor is a RFID reader and the second sensor is a RFID reader.

10. The system of claim 9, wherein the first sensor detects the presence or absence of only the first RFID tag within the first support receiver and the second sensor detects the presence or absence of only the second RFID tag within the second support receiver.

11. A system for controlling a vehicle lift that operates to linearly displace a vehicle with respect to a floor, the system comprising:

a power supply;

a motor that receives power from the power supply, the motor configured to linearly displace the vehicle with respect to the floor;

a supplemental support configured to be positioned between the vehicle and the floor when the vehicle is in a raised position;

a support receiver configured to receive the support;

a sensor configured to detect a presence or absence of the support within the support receiver; and a switch positioned between the power supply and the motor, the switch moveable between an open position in which the power supply is disconnected from the motor and a closed position in which the power supply is connected to the motor based on an output of the sensor, the switch is in the open position when the sensor detects the absence of the support within the support receiver and the switch is in the closed position when the sensor detects the presence of the support within the support receiver.

12. The system of claim 11, wherein the sensor is a spring plunger sensor moveable between an extended position and a depressed position, the sensor detects the absence of the support within the support receiver when the sensor is in the extended position and the sensor detects the presence of the support within the support receiver when the sensor is in the depressed position.

13. The system of claim 11 further comprising an electronic control unit operatively connected to the switch and the sensor, the electronic control unit having a processor and a memory unit that is coupled to the processor, the memory unit stores logic that, when executed by the processor, causes the electronic control unit to:

determine whether the support is positioned within the support receiver based on an output of the sensor; and in response to determining that the support is not positioned within the support receiver, control the switch to move into the open position, and in response to determining that the support is positioned within the support receiver, control the switch to move into the closed position.

14. The system of claim 11, wherein the switch moves from the open position to the closed position when the sensor detects the presence of the support within the support receiver.

15. The system of claim 14, wherein the switch moves from the closed position to the open position when the sensor detects the absence of the support within the support receiver.

16. The system of claim 15, wherein the support is a pair of supplemental supports, the support receiver is a pair of support receivers, and the sensor is a pair of sensors, wherein the pair of sensors are configured to detect the presence or absence of the pair of supports within the pair of support receivers, and wherein the switch is in the open position when one of the pair of sensors detects the absence of one of the pair of supports within one of the pair of support receivers and the switch is in the closed position when both the pair of sensors detects the presence of the pair of supports within respective pair of support receivers.

17. The system of claim 11, wherein the support is a first supplemental support and a second supplemental support, the support receiver is a first support receiver and a second support receiver, and the sensor is a first sensor and a second sensor, wherein the first sensor is configured to detect the presence or absence of the first support within the first support receiver and the second sensor is configured to detect the presence or absence of the second support within the second support receiver, and wherein the switch is in the open position when one of the first sensor detects the absence of the first support within the first receiver or the second sensor detects the absence of the second support within the second support receiver and the switch is in the closed position when the first sensor detects the presence of the first support within the first support receiver and the second sensor detects the presence of the second support within the second support receiver.

18. The system of claim 17, wherein the first support includes a first RFID tag and the second support includes a second RFID tag, and the first sensor is a RFID reader and the second sensor is a RFID reader, and wherein the first sensor detects the presence or absence of only the first RFID tag within the first support receiver and the second sensor detects the presence or absence of only the second RFID tag within the second support receiver.

19. The system of claim 11 further comprising:

a display device having a support indicator and an operation indicator; and an electronic control unit operatively connected to the switch, the sensor, and the display device, the electronic control unit having a processor and a memory unit that is coupled to the processor, the memory unit stores logic that, when executed by the processor, causes the electronic control unit to:

control the support indicator to indicate that the support is positioned within the support receiver and control the operation indicator to indicate that the power supply is supplying power to the motor when the switch is in the closed position.

20. The system of claim 19, wherein the electronic control unit is configured to control the support indicator to indicate that the support is not positioned within the support receiver and control the operation indicator to indicate that the power supply is not supplying power to the power supply when the switch is in the open position.

* * * * *